US005080613A

United States Patent [19]

Orui et al.

[11] Patent Number: 5,080,613

[45] Date of Patent: Jan. 14, 1992

[54] SEPARABLE MULTICONTACT ELECTRIC CONNECTOR

[75] Inventors: Kazuya Orui, Kawasaki; Akira Mitsuhashi, Tokyo; Shigeki Mori, Yokohama; Masayoshi Shigihara, Tokyo, all of Japan

[73] Assignee: Fujitsu Limited, Kawasaki, Japan

[21] Appl. No.: 585,503

[22] Filed: Sep. 20, 1990

[30] Foreign Application Priority Data

Sep. 20, 1989 [JP] Japan ..... 1-241762

[51] Int. Cl.[5] ..... H01R 17/00

[52] U.S. Cl. ..... 439/660; 439/188; 439/259

[58] Field of Search ..... 439/635, 170-174, 439/188, 189, 668, 669, 675, 660, 259, 260, 924, 676, 261-267, 620; 200/51.11, 51.05, 257, 260, 252, 547, 550, 291

[56] References Cited

U.S. PATENT DOCUMENTS

| | | | |
|---|---|---|---|
| 2,163,201 | 6/1939 | Kalencik | 439/172 |
| 3,396,358 | 8/1968 | Ballard et al. | 439/172 |
| 3,920,302 | 11/1975 | Cutchaw | 439/188 |
| 3,997,231 | 12/1976 | Sherwood | 439/264 |
| 4,076,362 | 2/1978 | Ichimura | 439/264 |
| 4,701,134 | 10/1987 | Jones | 200/252 |
| 4,737,602 | 4/1988 | Yamamoto | 200/291 |
| 4,885,438 | 12/1989 | Tajima | 200/550 |

*Primary Examiner*—David L. Pirlot
*Attorney, Agent, or Firm*—Staas & Halsey

[57] ABSTRACT

A combination of a plug assembly to be attached to a printed wiring board, and a receptacle assembly to be attached to a shelf back-board. The plug assembly comprises a set of plug contacts mounted to a plug housing. The receptacle assembly comprises a receptacle housing capable of mating engagement with the plug housing, and a set of resilient, bladelike receptacle contacts mounted to the receptacle housing. Each bladelike receptacle contact has two protuberances formed in longitudinally spaced positions thereon. Each receptacle contact is so made that only one of the two protuberances thereon is normally held against one associated plug contact upon interfitting engagement of the receptacle housing with the plug housing. At least selected one of the receptacle contacts butts on a projection on the receptacle housing and is thereby resiliently displaced in such a direction that the two protuberances on the displaced receptacle contact are both held against one associated plug contact. Thus, when the plug assembly is being inserted in the receptacle assembly, the plug contacts engage some of the receptacle contacts earlier than the others.

11 Claims, 13 Drawing Sheets

SEPARABLE MULTICONTACT ELECTRIC CONNECTOR

BACKGROUND OF THE INVENTION

Our invention relates to electric connectors, and more particularly to those of the separable type. Still more particularly, our invention deals with a separable multicontact connector suitable for use with printed wiring boards or the like.

It has been known and practiced widely to mount integrated circuits, large-scale integrated circuits or like semiconductor devices on printed circuit boards to form electronic circuit packages. It has also been known to mount such electronic circuit packages to shelf backboards via separable multicontact electric connectors. Such connect-disconnect electronic circuit packages are finding ever-increasing acceptance with computers, communications equipment, and allied electronic appliances for their greater versatility and flexibility in use and for the greater ease of maintenance.

We have found a problem left unsolved in connection with the separable multicontact connectors for such applications. The connection and disconnection of the electronic circuit packages are usually made with the power system cut off. However, some power systems permit no interruption. Then, if all the contacts of the plug assembly and receptacle assembly of the connector are to move into and out of engagement with one another, noise may be generated which can cause the misoperation or, in the worst case, destruction of the device.

We know some prior art separable connectors that have been developed in recent years in order to defeat this inconvenience. Such known devices are more or less alike in employing either a plug assembly or a receptacle assembly having signal, power, and ground contacts of different lengths. The ground contacts of the plug and receptacle assemblies first come into interengagement when the assemblies are being joined to each other, and last go out of interengagement when the assemblies are being separated.

We object to such conventional separable connectors because of their lack of ready adaptability to applications other than the one for which they were originally designed. The sequence of interengagement of the different plug and receptacle contacts has so far been determined as aforesaid by their relative lengths. Consequently, for each different sequence of contact interengagement, different connectors have had to be manufactured which meet that particular requirement. Or the connector manufactures have had to make and hold in stock an assortment of such different connectors to fulfill a variety of customer requirements. This practice is of course uneconomical. Besides, since no infinite variety of connectors can possibly be prepared, limitations have been imposed upon the design of the electronic systems that need such separable connectors.

There is an additional objection to the conventional separable connectors. The provision of plug or receptacle contacts of different lengths has itself been very costly. Moreover, they have had to be driven into, or otherwise mounted to, the plug or receptacle housings in prescribed positions thereon. Thus the manufacture of the prior art devices has involved many steps and required much costs.

SUMMARY OF THE INVENTION

We have hereby invented how to lend adaptability to separable multicontact connectors, making them possible to meet a variety of system requirements with little or no alteration in construction, and hence how to make them easier and more economical of manufacture.

Briefly, our invention may be summarized as a separable multicontact electric connector suitable for use with packaged electronic circuits or the like, comprising a plug assembly and a receptacle assembly coupled to each other, both mechanically and electrically, in a readily separable manner. The plug assembly comprises a plurality of plug contacts fixedly mounted to a plug housing of electrically insulating material. The receptacle assembly comprises a receptacle housing of electrically insulating material capable of interfitting engagement with the plug housing, and a plurality of generally elongate receptacle contacts of resilient material mounted to the receptacle housing. Each receptacle contact has two protuberance formed in longitudinally spaced positions thereon. Each receptacle contact is so disposed within the receptacle housing that only one of the protuberances (situated farther away from the plug assembly than the first protuberance) on each receptacle contact is normally held against one associated plug contact upon interfitting engagement of the receptacle housing with the plug housing. Also included are abutment means on the receptacle housing for abutting engagement with any selected one of receptacle contacts. Any selected receptacle contact in engagement with the abutment means is thereby resiliently displaced in such a direction that both protuberances thereon become held against one associated plug contact upon interfitting engagement of the receptacle housing with the plug housing.

Thus, according to our invention, the plug contacts engage any one or more receptacle contacts which are in engagement with the abutment means, earlier than the other receptacle contacts which are out of engagement with the abutment means. Only the positions of the abutment means on the receptacle housing may therefore be changed in order to make the plug contacts engageable with some receptacle contacts earlier than the others. All the receptacle contacts, as well as all the plug contacts, can be of exactly the same construction and can be mounted to their housings in the same way. It will therefore be appreciated that the separable connector of our invention can be manufactured far more easily and economically than heretofore and yet is readily adaptable for a wide variety of system requirements in use.

The abutment means take the form of a projection or projections formed in a selected position or positions on the receptacle housing in one piece therewith in a preferred embodiment of our invention. Therefore, in this particular embodiment, only the receptacle housing needs alteration in the positions of the projections in order to adapt the connector for different applications.

Additional embodiments are disclosed in which not only the receptacle contacts but also the receptacle housing needs no alteration in construction. In one such embodiment the receptacle housing is provided with one or more replaceable adapter plates having projections formed in selected positions thereon for abutment against desired receptacle contacts. Only the adapter plates may therefore be changed for adapting the connector to different use.

In another additional embodiment the receptacle housing is provided with as many contact pushers as there are receptacle contacts mounted therein. The contact pushers are pivotably mounted in windows cut in the receptacle housing. Any desired contact pusher or pushers may be manually actuated to make the associated receptacle contacts engageable with the plug contacts earlier than the others. So constructed, the connector needs no modification of its constituent parts at all for adaptation to a variety of requirements in use.

The above and other features and advantages of our invention and the manner of realizing them will become more apparent, and the invention itself will best be understood, from a study of the following description and appended claims, with reference had to the attached drawings showing the preferred embodiments of our invention.

DESCRIPTION OF THE PREFERRED EMBODIMENTS

Figure 1:
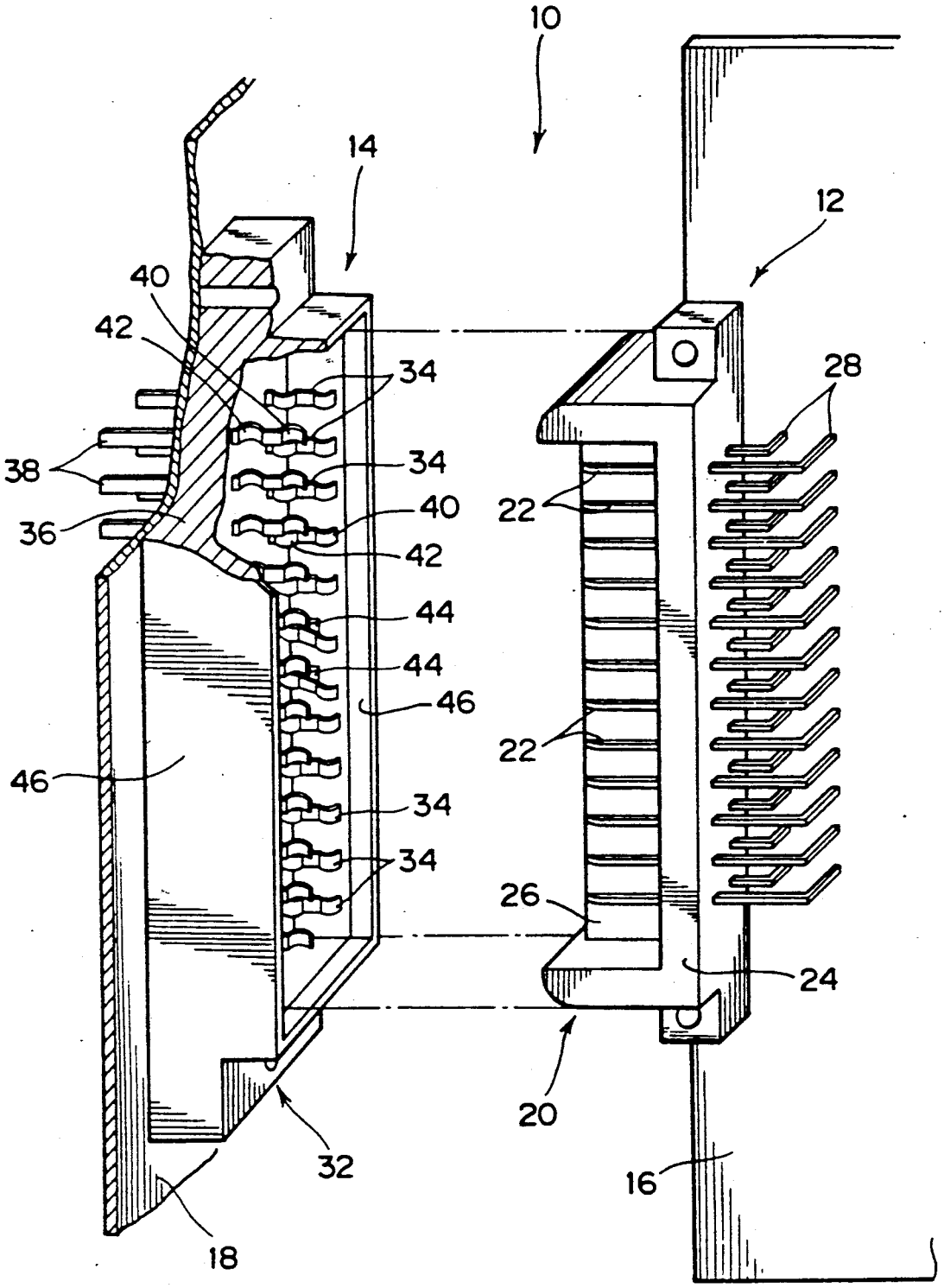
FIG. 1 is a perspective view, partly shown broken away for clarity, of the separable multicontact connector constructed in accordance with the novel concepts of our invention.

We will now describe our invention in detail as embodied in the separable multicontact connector shown in perspective in FIG. 1 and therein generally designated 10. This connector 10 comprises a plug assembly 12 and a receptacle assembly 14, which are shown separated from each other for clarity. The plug assembly 12 is shown attached to a printed wiring board 16 to which semiconductor circuit components, not shown, may be mounted to form an electronic circuit package. The receptacle assembly 14 is shown mounted to a shelf backboard 18.

Figure 2A:
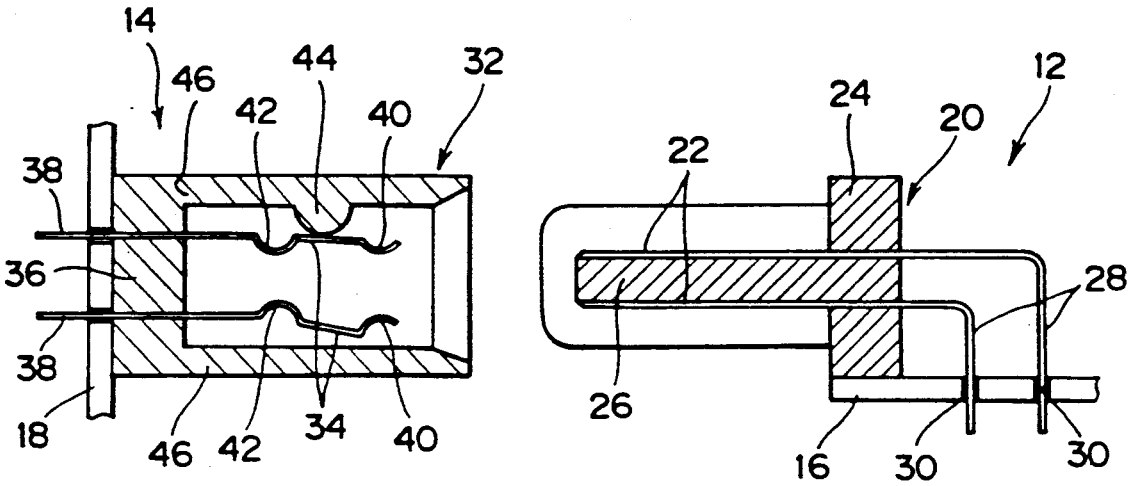
FIGS. 2A, 2B and 2C are a series of sectional illustrations explanatory of how the plug and receptacle assemblies of the FIG. 1 connector are coupled to each other.
Figure 2B:
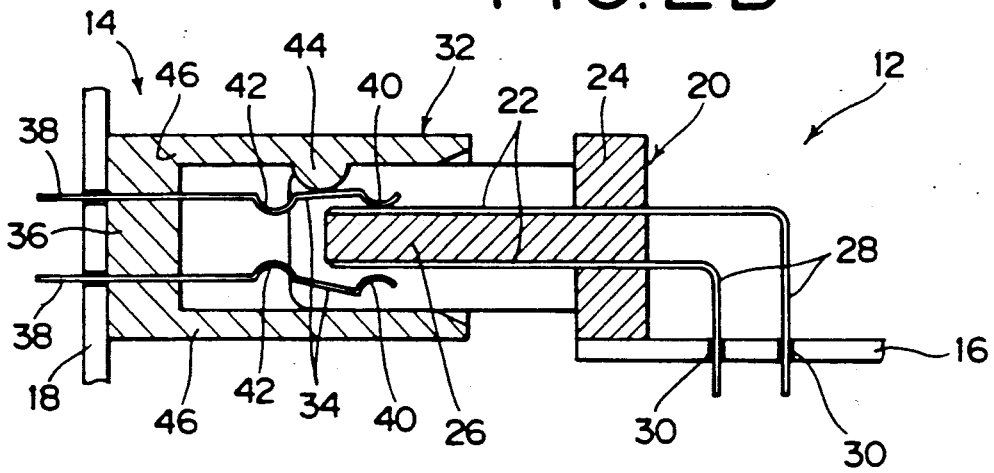

As will be seen also from FIGS. 2A-2B, which sequentially illustrates how the plug assembly 12 and the receptacle assembly 14 are interengaged, the plug assembly 12 comprises a plug housing 20 of electrically insulating material, and a plurality of plug contacts 22 mounted to the plug housing in two rows. The plug housing has a bottom 24 with a rib 26 formed thereon. The two rows of plug contacts 22 are held against the opposite sides of the rib 26 at constant spacings. The plug contacts 22 have rearward extensions 28 extending through the bottom 24 of the plug housing 20 and are bent at a right angle to extend through holes 30 in the printed wiring board 16. The plug contact extensions 28 are conventionally soldered to the printed wiring pattern on the board 16.

As shown also in FIGS. 1 and 2A-2C, the receptacle assembly 14 comprises a receptacle housing 32 of electrically insulating material, and a plurality of opposed, bladelike receptacle contacts 34 of resilient material mounted to the receptacle housing. The receptacle contacts 34 are also arranged in two rows for receiving the two rows of plug contacts 22 therebetween. The receptacle housing 32 is in the form of an elongate box, open toward the plug assembly 12 and sized and shaped to fit over the plug housing 20. The receptacle contacts 34 are partly embedded in the bottom 36 of the receptacle housing 32 and extend therefrom toward the plug assembly 12. The rearward extensions 38 of the receptacle contacts 34 extend through the backboard 18 and are soldered thereto.

Figure 3:
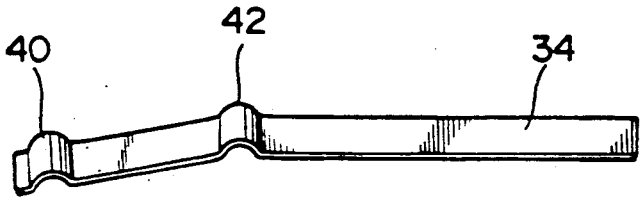
FIG. 3 is a perspective view of one of the receptacle contacts of the FIG. 1 connector.

As illustrated on an enlarged scale in FIG. 3, each receptacle contact 34 takes the form of a single strip of sheet metal in this particular embodiment. The sheet metal strip is formed to include two rounded parts to provide a first protuberance 40 at or adjacent its end directed toward the plug assembly 12, and a second protuberance 42 spaced therefrom in a direction away from the plug assembly. FIG. 2A indicates that the two protuberances 40 and 42 on each receptacle contact project toward similar protuberances on the other receptacle contact of each such opposed contact pair.

It will also be observed from FIGS. 2A and 3 that the distal end portion of each receptacle contact 34, including the first protuberance 40, is somewhat bent away from the other receptacle contact of each such opposed contact pair.

Seen at 44 in FIG. 2A is a projection or abutment formed on the inside surface of one of the pair of opposed side walls 46 of the receptacle housing 32. FIG. 1 reveals two such projections 44 formed on one of the side walls 46 of the receptacle housing 32 by way of example. One or more similar projections may be formed on the other side wall of the receptacle housing. Thus, in this particular embodiment, the two selected ones of one row of receptacle contacts 34 butt on the projections 22 and are thereby resiliently displaced toward the other row of receptacle contacts.

Operation

Figure 2C:
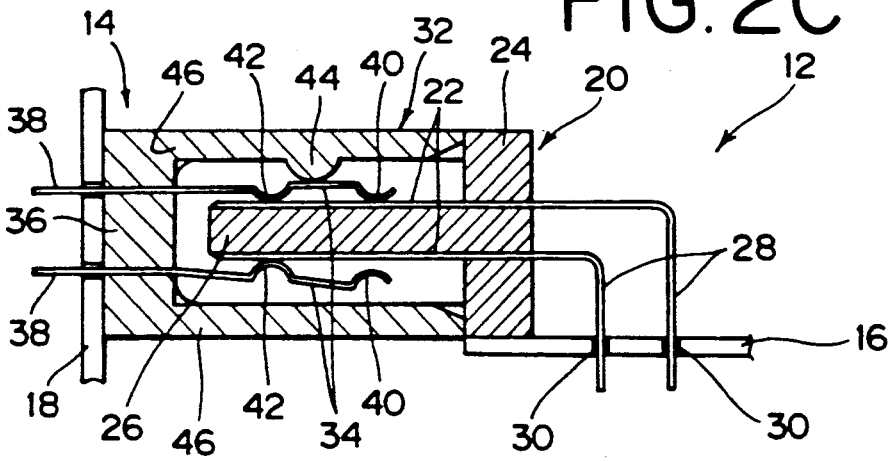

We will refer primarily to FIGS. 2A-2C for an explanation of how the plug assembly 12 and receptacle assembly 14 of the separable connector 10 are interconnected, with the plug contacts 22 engaging some of the receptacle contacts 34 earlier than the others.

As will be noted from FIG. 2A, any selected receptacle contact 34 butting against the projection 44 on the receptacle housing 32 is thereby resiliently displaced toward the other row of receptacle contacts. Consequently, the two protuberances 40 and 42 of this selected receptacle contact project toward the other row of receptacle contacts to approximately the same extent. The other receptacle contact 34 shown here, behind which no projection 44 is formed on the receptacle housing 32, has its first protuberance 40 disposed farther away from the other row of receptacle contacts than is its second protuberance 42.

FIG. 2B shows the plug assembly 12 inserted halfway in the receptacle assembly 14. It will be seen that one of the two plug contacts 22 shown here has already engaged the first protuberance 40 on the selected receptacle contact 34 butting against the projection 44. The other plug contact 22 does not engage the protuberance 40 on the other, unselected receptacle contact 34.

FIG. 2C shows the plug assembly 12 subsequently inserted fully in the receptacle assembly 14. Both plug contacts 22 are engaged with the second protuberances 42 on the selected and unselected receptacle contacts 34. It is thus seen that the plug contacts engage the selected receptacle contact earlier than the unselected receptacle contact.

Therefore, in use of this separable connector 10, the projections 44 may be formed on the receptacle housing 32 behind those receptacle contacts 34 which are intended for grounding. The other receptacle contacts may be used for signal and power transmission. Then the plug contacts will engage the ground receptacle contacts earlier than the power and signal receptacle contacts when the plug and receptacle assemblies are being coupled to each other. When the plug and receptacle assemblies are being separated, on the other hand, the plug contacts will disengage the power and signal receptacle contacts earlier than the ground receptacle contacts.

The separable connector 10 offers the advantage that the plug contacts 22 and receptacle contacts 34 can all be of the same size and shape and can all be mounted to their housings 20 and 32 in the same way. Thus, being made up of a smaller number of components parts than the comparable prior art devices, the separable connector 10 is manufacturable far more easily and economically than heretofore. Only the receptacle housings having projections formed in different positions thereon may be prepared for adapting the separable connector 10 to different system requirements.

Second Embodiment

Figure 4:
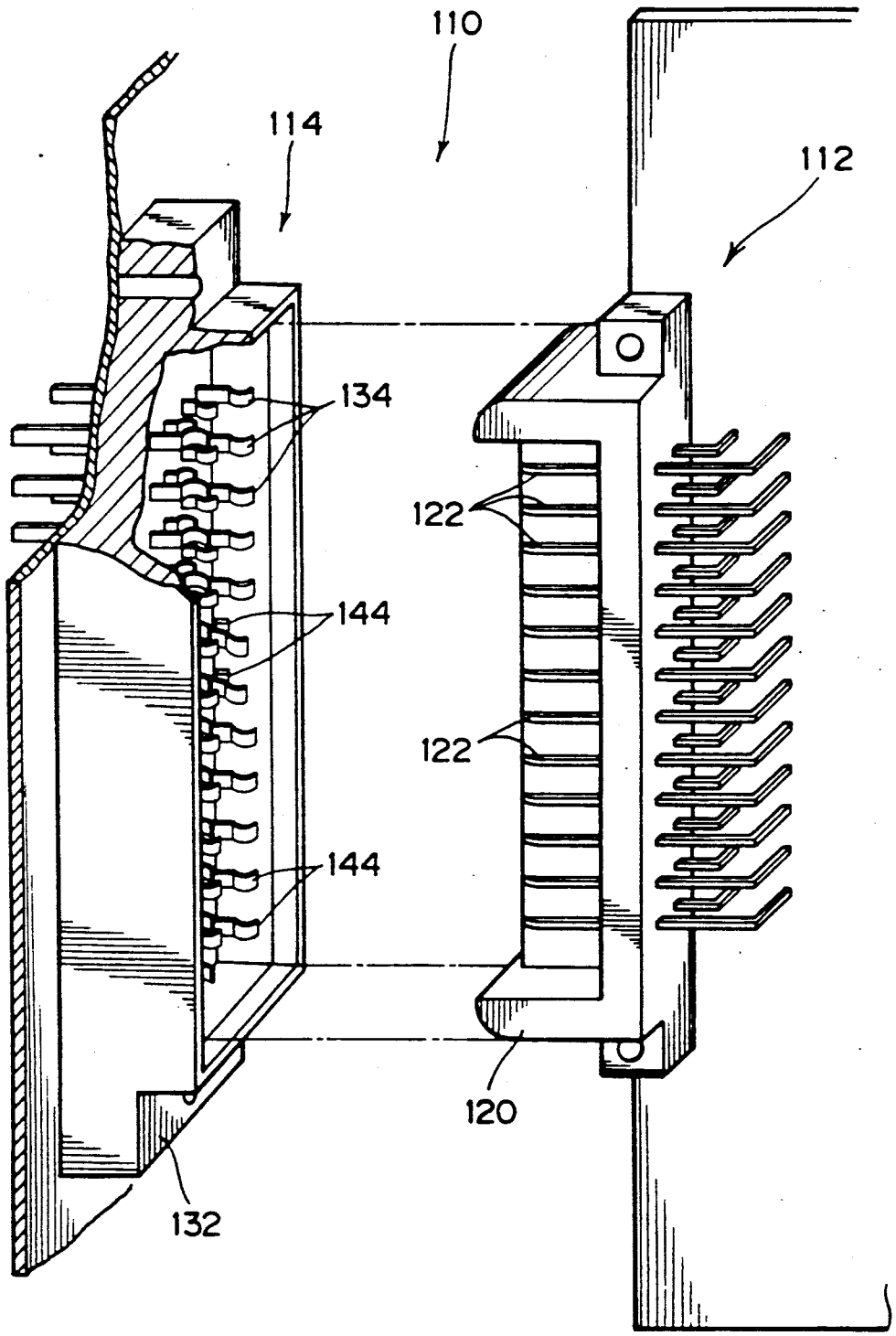
FIG. 4 is a view similar to FIG. 1 but showing another preferred form of separable connector according to our invention.

The separable connector 110 shown in FIG. 4 represents a slight modification of the FIG. 1 connector 10. It comprises a plug assembly 112 and a receptacle assembly 114. The plug assembly 112 is of exactly the same construction as the plug assembly 12 of the connector 10, having two rows of plug contacts 122 mounted to a plug housing 120.

The receptacle assembly 114 is substantially similar to the receptacle assembly 14 of the FIG. 1 connector 10, having two rows of receptacle contacts 134 mounted within a receptacle housing 132. A projection or projections 144 are formed in selected positions on the receptacle housing 132 for abutting engagement with selected ones of the receptacle contacts 134. The receptacle housing 132 with the projections 144 is identical in construction with its counterpart 32 of the FIG. 1 connector 10. However, the receptacle contacts 134 is of different construction from the receptacle contacts 34 of the connector 10.

Figure 5A:
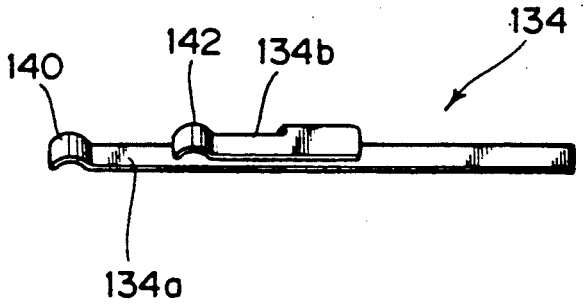
FIG. 5A is a perspective view of one of the receptacle connectors of the FIG. 4 connector.

We have illustrated one such modified receptacle contact 134 in FIG. 5A. This receptacle contact is formed from a blank 134' shown in FIG. 5B. The receptacle contact blank 134' is a punching of sheet metal, having two parallel strip portions **134*a* and 134*b* of different lengths. The shorter strip portion 134*b* is joined at one end portion to the mid-section of the longer strip portion 134*a*. Both strip portions 134*a* and 134*b* have oppositely rounded end portions 140' and 142'. These strip portions may be folded one over the other to form the receptacle contact 134 of FIG. 5A**.

Thus, in the completed receptacle contact 134, the longer strip portion **134*a* provides the first protuberance 140 at its end directed toward the plug assembly 112. The shorter strip portion 134*b* provides the second protuberance 142 spaced from the first protuberance 140 in a direction away from the plug assembly 112**.

As will be noted by referring back to FIG. 4, each such receptacle contact 134 is mounted to the plug housing 132 with its longer strip portion **134*a* disposed closer to one of the opposite side walls of the receptacle housing. The longer strip portions of some selected receptacle contacts are therefore held against the projections 144 on the receptacle housing 132**, thereby to be resiliently displaced toward the other row of receptacle contacts.

Operation of Second Embodiment

Figure 6A:
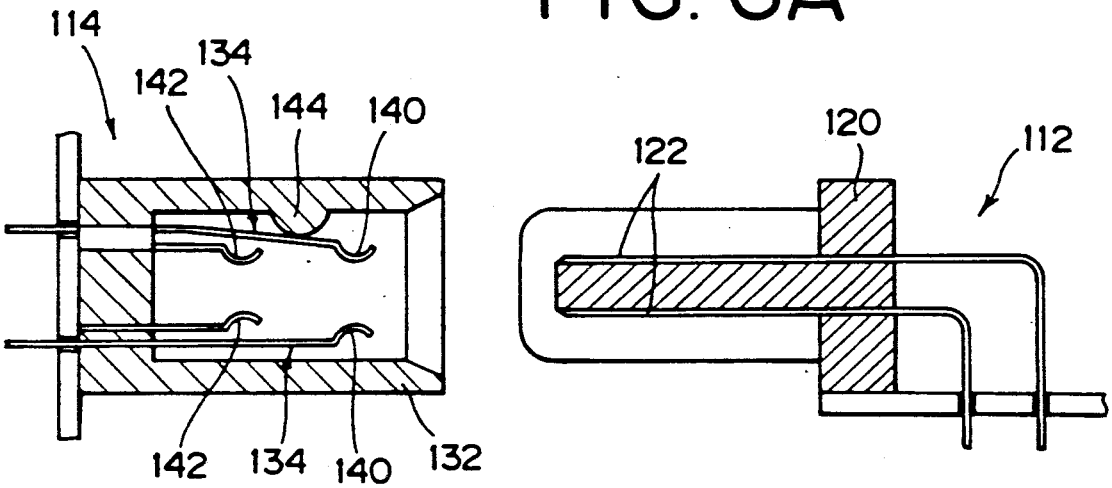
FIGS. 6A, 6B and 6C are a series of sectional illustrations explanatory of how the plug and receptacle assemblies of the FIG. 4 connector are coupled to each other.
Figure 6B:
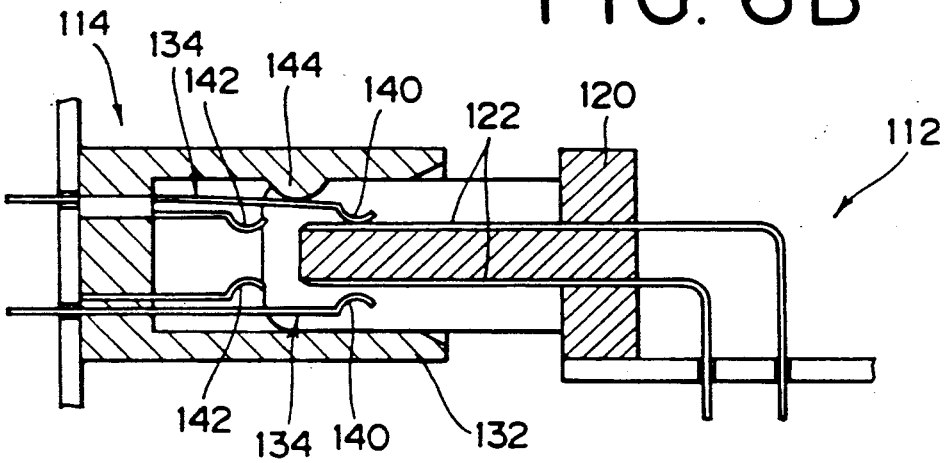
Figure 6C:
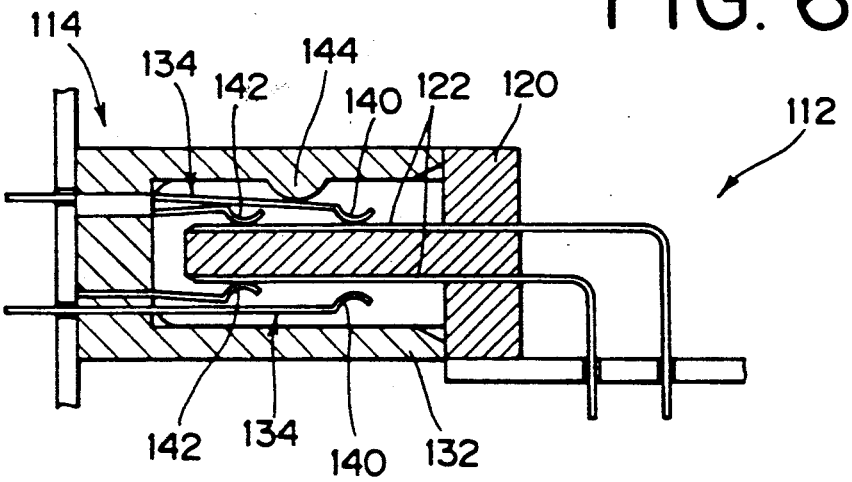

We will refer to FIGS. 6A-6C for the following discussion of how the plug assembly 112 and receptacle assembly 114 of the separable connector 110 are interengaged.

As will be noted from FIG. 6A, the longer strip portion of any selected receptacle contact 134 abuts against the projection 144 on the receptacle housing 132 and is thereby resiliently displaced toward the other row of receptacle contacts. Consequently, the two protuberances 140 and 142 of this selected receptacle contact project toward the other row of receptacle contacts to approximately the same extent. The first protuberance 140 on the longer strip portion of the other receptacle contact 134 shown here, behind which no projection 144 is formed on the receptacle housing 132, lies farther away from the other row of receptacle contacts than does the second protuberance 142 on its shorter strip portion.

FIG. 6B shows the plug assembly 112 inserted halfway in the receptacle assembly 114. It will be seen that one of the two plug contacts 122 shown here has already engaged the first protuberance 140 on the longer strip portion of the selected receptacle contact 134 butting against the projection 144. The other plug contact 122 does not engage the protuberance 140 on the longer strip portion of the other, unselected receptacle contact 134.

FIG. 6C shows the plug assembly 112 subsequently inserted fully in the receptacle assembly 114. Both plug contacts 122 are engaged with the second protuberances 142 on the shorter strip portions of the selected and unselected receptacle contacts 134. It is thus seen that the plug contacts engage the selected receptacle contact earlier than the unselected receptacle contact as in the first disclosed connector 10.

An inspection of FIGS. 6A–6C will indicate that the two strip portions of each receptacle contact 134 are substantially independently supported by the receptacle housing 132 in a cantilever fashion, having the protuberances 140 and 142 at their distal ends. The receptacle contacts 134 of this connector 110 are therefore more positive and reliable in operation. The other advantages gained by this connector 110 are as previously set forth in connection with the FIG. 1 connector 10.

Third Embodiment

Figure 7:
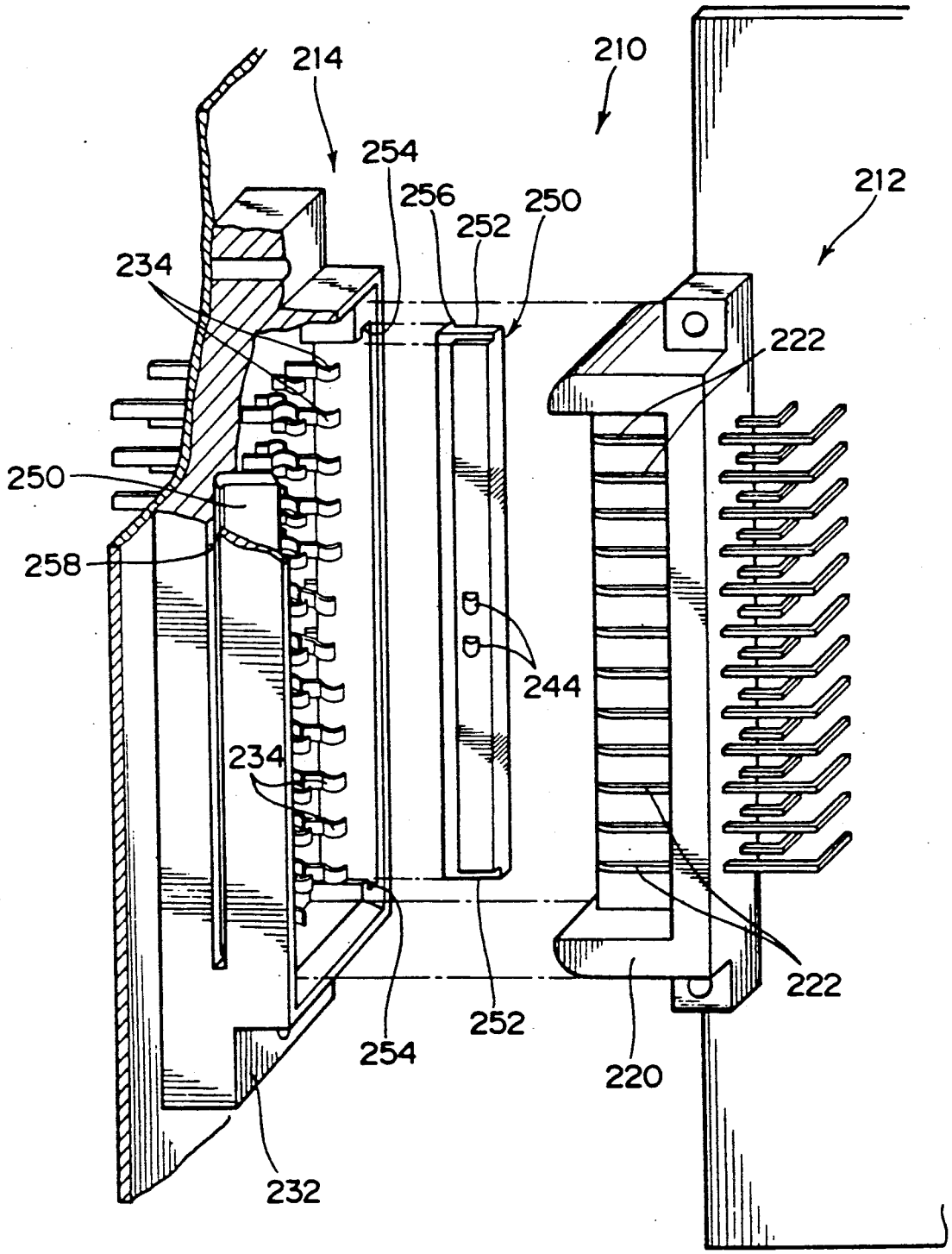
FIG. 7 is a view similar to FIG. 1 but showing still another preferred form of separable connector according to our invention.

FIG. 7 shows a further preferred form of separable connector 210 according to our invention. This connector 210 also comprises a plug assembly 212 and a receptacle assembly 214. The plug assembly 212 is of exactly the same construction as the plug assemblies 12 and 112 of the above disclosed connectors 10 and 110, having two rows of plug contacts 222 mounted to a plug housing 220.

The connector 210 features one or more, two in this embodiment, snap-on adapter plates 250 replaceably mounted to the housing 232 of the receptacle assembly 214. Each adapter plate 250 has one or more projections 244 formed in selected positions thereon for abutting engagement with selected ones of receptacle contacts 234 mounted in two rows to the receptacle housing 232. We have shown the receptacle contacts 234 as being of the same construction as the receptacle contacts 134 of the FIG. 4 connector 110.

Elongated to fit inside the pair of opposed side walls of the receptacle housing 232, the adapter plates 250 have each a pair of tongues 252 at its opposite ends for sliding engagement in grooves 254 in the receptacle housing. Also, each adapter plate 250 has a rib 256 formed along one of its longitudinal edges for engagement in one of two apertures 258 in the receptacle housing 232.

The snap-on adapter plates 250 can be readily mounted to the receptacle housing 232 by engaging their pairs of tongues 252 in the receptacle housing grooves 254 and then by pushing the adaptor plates into the receptacle housing. The ribs 256 on the adapter plates 250 will snap into the receptacle housing apertures 258 by virtue of their resiliency when the adapter plates are fully pushed into the receptacle housing 232.

Operation of Third Embodiment

Figure 8A:
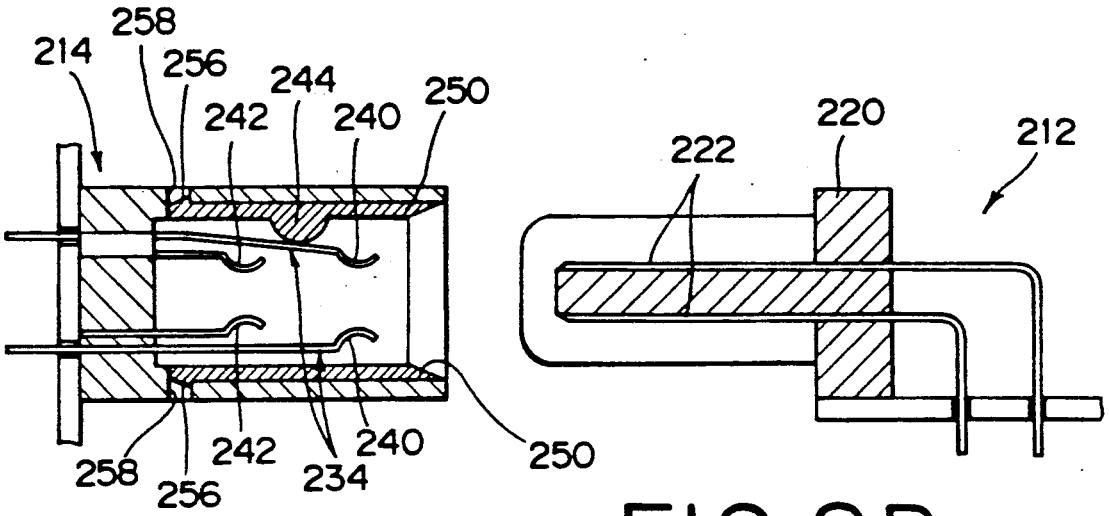
FIGS. 8A, 8B and 8C are a series of sectional illustrations explanatory of how the plug and receptacle assemblies of the FIG. 7 connector are coupled to each other.
Figure 8B:
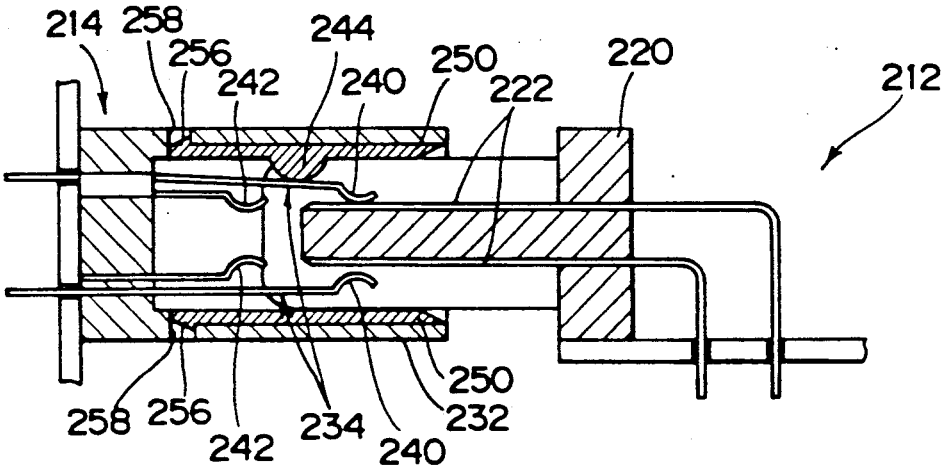
Figure 8C:
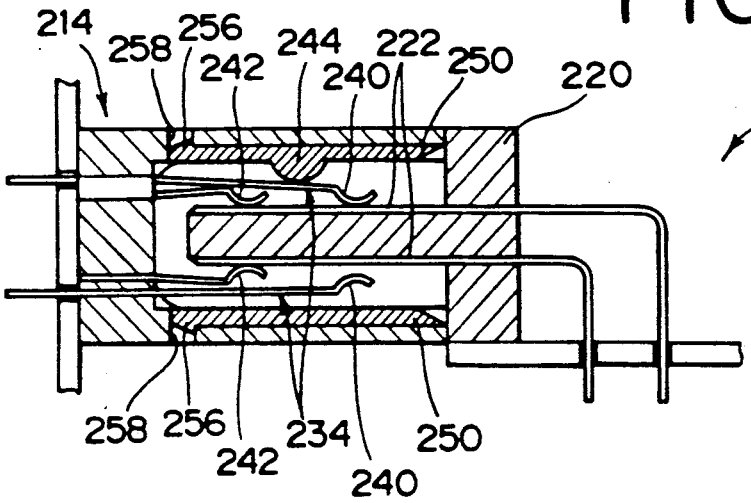

A study of FIGS. 8A–8C will show that, in this separable connector 210, the plug contacts 222 engage and disengage the selected and unselected receptacle contacts 234 via the first and second protuberances 240 and 242 thereon in the same way as in the connectors 10 and 110 disclosed previously. We therefore consider it unnecessary to repeat such operational description.

We would like to invite the reader's attention to the fact that the projections or abutment means 244 are formed on the snap-on adapter plates 250 in this connector 210, instead of being formed directly on the receptacle housing as in the foregoing embodiments. The use of such adapters makes it possible to standardize not only the receptacle contacts but also the receptacle housing, in addition to the plug contacts and the plug housing. Only the adapters having projections formed in different positions thereon may be prepared to adapt the connector 210 to a variety of requirements in use.

Figure 5B:
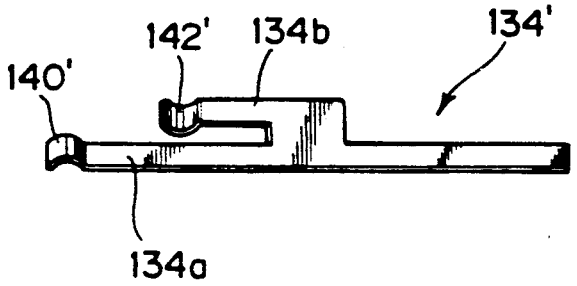
FIG. 5B is a perspective view of a sheet metal blank from which the receptacle connector of FIG. 5A is made.

It is to be understood that the receptacle contacts 234 of the FIGS. 5A and 5B construction employed in this connector 210 are by way of example only. The receptacle contacts 34 of FIG. 3 could be employed in combination with the adapter plates 250.

Fourth Embodiment

FIGS. 9–12 show a further preferred form of receptacle assembly 314 according to our invention. This receptacle assembly 314 is also intended for use with the plug assembly 12, 112 or 212 of the foregoing embodiments.

The receptacle assembly 314 comprises a receptacle housing 332 in the form of an elongate box, open toward the unshown plug assembly. Cantilevered within the receptacle housing 332 are two rows of receptacle contacts 334 which are shown to be of the FIGS. 5A and 5B construction, although, here again, we could employ the receptacle contacts 34 of FIG. 3. Thus, as indicated in FIG. 10, each receptacle contact 334 comprises a longer strip portion **334*a* with a first protuberance 340, and a shorter strip portion 334*b* with a second protuberance 342**.

A feature of the receptacle assembly 314 resides in contact pushers 360 mounted to the receptacle housing 332 for movement into and out of abutting engagement with the longer strip portions **334*a* of the respective receptacle contacts 334. Since the receptacle contacts 334 are arranged in two rows in this embodiment, the contact pushers 360 are mounted in windows 362 in the pair of confronting side walls 346 of the receptacle housing 332** in opposed relation to the respective receptacle contacts.

Figure 9:
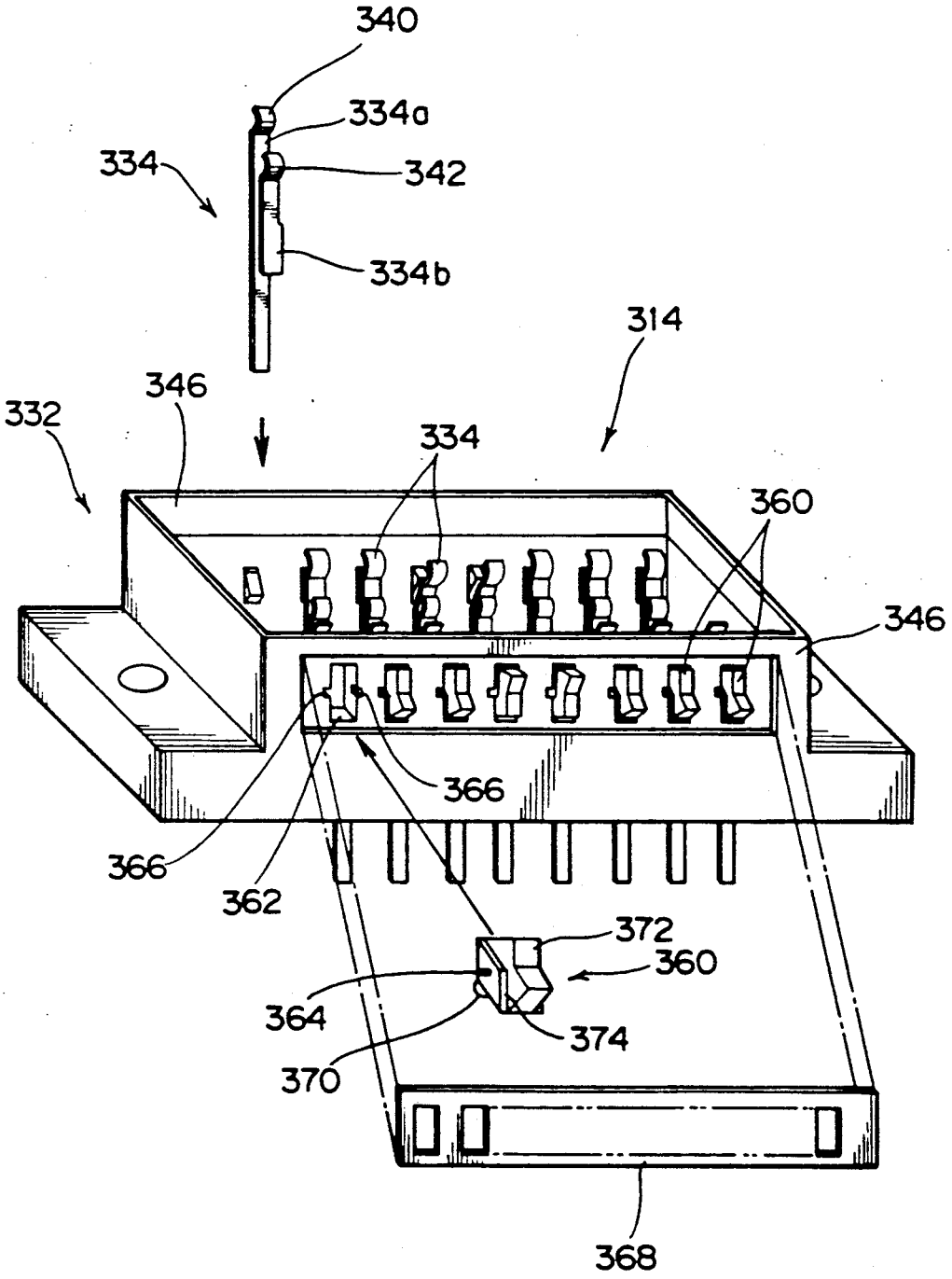
FIG. 9 is a partly exploded perspective view of yet another preferred form of receptacle assembly according to our invention.
Figure 10:
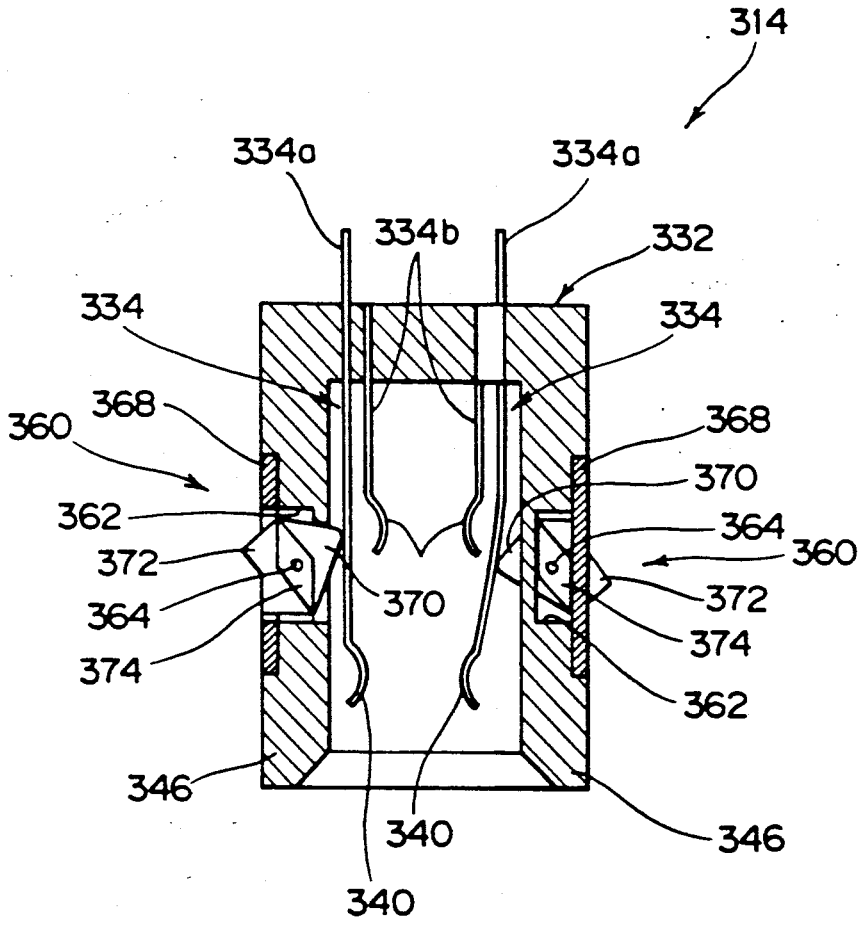
FIG. 10 is a cross section through the receptacle assembly of FIG. 9.
Figure 11:
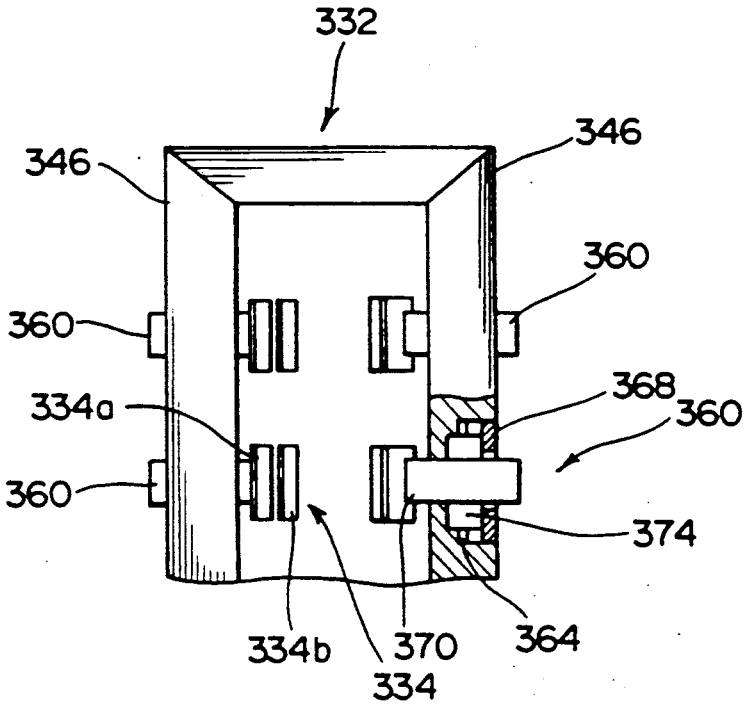
FIG. 11 is an enlarged, fragmentary front elevation of the FIG. 9 receptacle assembly.
Figure 12:
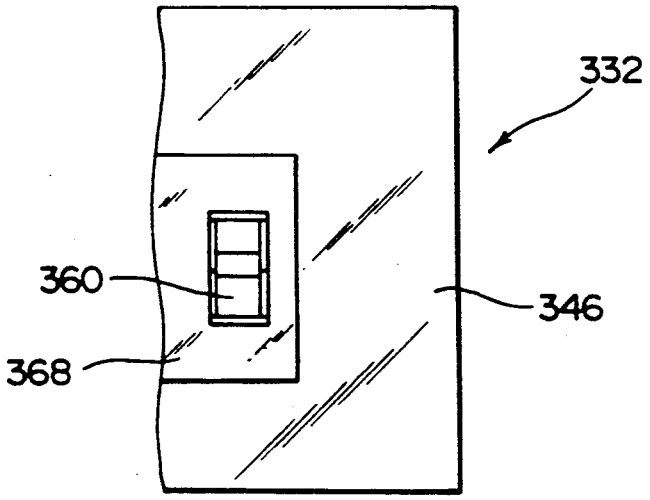
FIG. 12 is an enlarged, fragmentary side elevation of the FIG. 9 receptacle assembly.

As will be understood from both FIGS. 9 and 10, each contact pusher 360 has a pair of trunnions 364 on its opposite sides which are rotatably received in bearing holes 366 in the receptacle housing 332. The trunnions 365 are retained in the bearing holes 366 by attaching a pair of retainer plates 368 to the side walls 346 of the receptacle housing 332. Thus the contact pushers 360 are independently pivotable with respect to the receptacle housing 332 into and out of abutting engagement with the respective receptacle contacts 334.

Each contact pusher 360 comprises a contact engagement portion 370 for direct engagement with one of the receptacle contacts 334, a fingertip contact portion 372 for pivoting the contact pusher under fingertip pressure, and a pair of limit stops 374 for limiting the angle of rotation of the contact pusher.

Operation of Fourth Embodiment

The operator may exert fingertip pressure on the fingertip contact portion 372 of each contact pusher 360 for pivoting the same between a retracted position, shown to the left in FIG. 10, and a working position shown to the right in the same figure. The contact engagement portion 370 of each contact pusher 360 applies no bending stress to the longer strip portion **334*a* of the associated receptacle contact 334 when the contact pusher is in the retracted position. The first protuberance 340 of this receptacle contact is therefore held spaced farther away from the other row of receptacle contacts than is its second protuberance 342**.

When each contact pusher 360 is pivoted to the working position, on the other hand, its contact engagement portion 370 will act on the longer strip portion 334*a* of the associated receptacle contact 334, causing its elastic deformation as shown. The longer strip portion 334*a* will be thus bent in such a direction, and to such an extent, that the first protuberance 340 thereon will become spaced from the other row of receptacle contacts to the same extent as the second protuberance 342 on the shorter strip portion 334*b* of the same receptacle contact 334. Rhombic in shape as seen in a side view as in FIG. 10, each limit stop 374 has its two adjacent sides alternately held against the inside of one of the retainer plates 368 for limiting the angular motion of the contact pusher 360 between the retracted and the working position.

Thus the contact pushers 360 may be selectively actuated to cause any desired one or ones of the receptacle contacts 334 to be engaged by the plug contacts earlier than the others when the plug and receptacle assemblies are being coupled to each other, and later than the others when the plug and receptacle assemblies are being separated. It is the pronounced advantage of this receptacle assembly 314 that none of its components needs alteration for adaptation to the different requirements of specific applications.

Fifth Embodiment

FIGS. 13–16 are illustrations of a still further preferred form of receptacle assembly 414 according to our invention. This receptacle assembly is also intended for use with the plug assembly 12, 112 or 212 disclosed previously.

Figure 13:
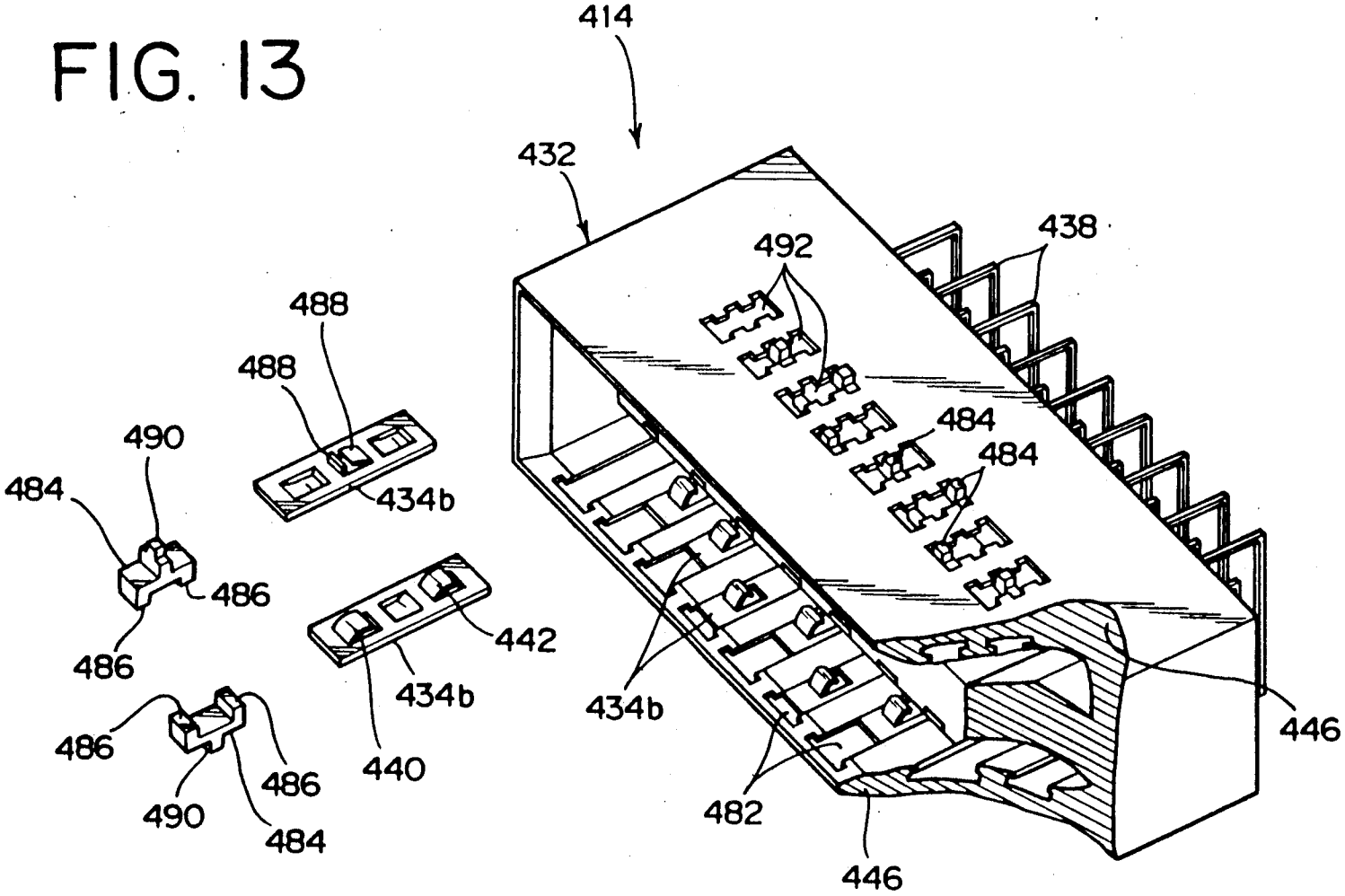
FIG. 13 is a partly exploded perspective view, partly shown broken away for clarity, of a further preferred form of receptacle assembly according to our invention.
Figure 14:
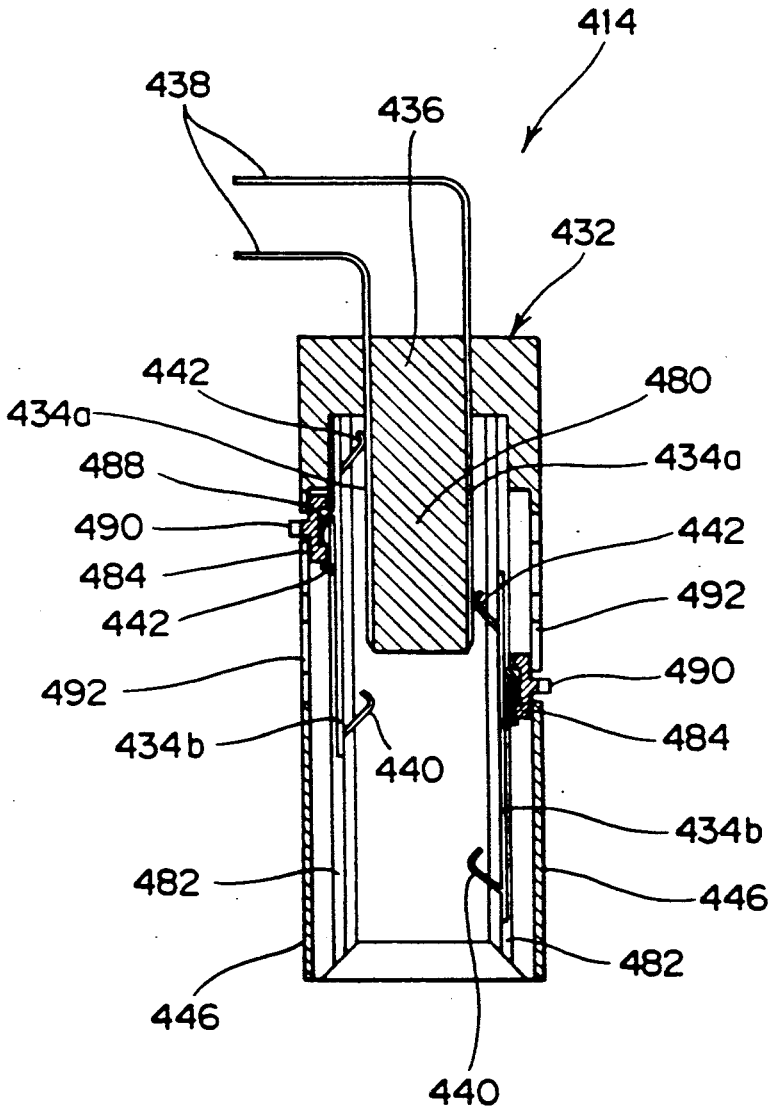
FIG. 14 is an enlarged cross section through the FIG. 13 receptacle assembly.
Figure 15:
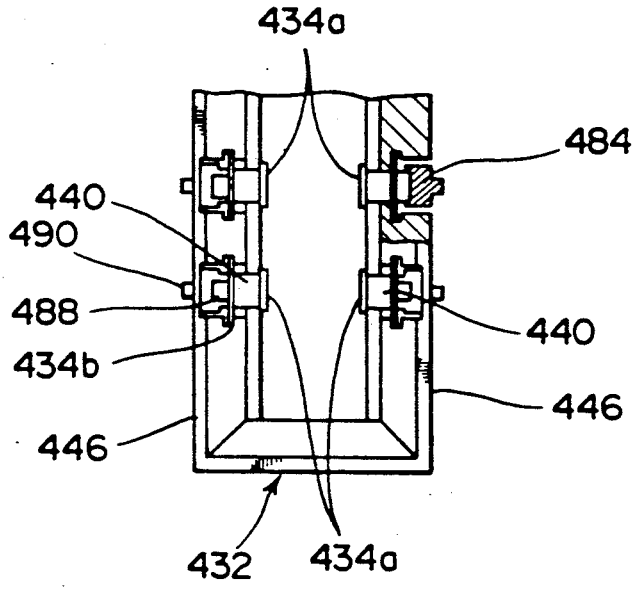
FIG. 15 is an enlarged, fragmentary front elevation of the FIG. 13 receptacle assembly.

The receptacle assembly 414 comprises a plurality of fixed receptacle contacts 434*a*, FIG. 14, fixedly mounted to a receptacle housing 432 and therein arranged in two rows, and a plurality of movable receptacle contacts 434*b*, FIGS. 13 and 14, mounted to the receptacle housing for movement toward and away from the plug assembly. The fixed receptacle contacts 434*a* have rearward extensions 438 which are shown bent right angularly for insertion, for example, in holes in a printed wiring board. It is the movable receptacle contacts 434*b* that are to be engaged with the plug contacts. The movable receptacle contacts 434*b* are in sliding engagement with the respective fixed receptacle contacts 434*a* in a manner to be set forth subsequently.

The receptacle housing 432 is in the form of an elongate box, open toward the plug assembly, and has a rib 480 formed on its bottom 436. The fixed receptacle contacts 434*a* are closely held against both sides of the rib 480 at constant spacings and extend through the bottom 436.

Each in the form of a strip of sheet metal, the movable receptacle contacts 434*b* are slidably received in recessed guideways 482 in the inside surfaces of the pair of opposed side walls 446 of the receptacle housing 432 for longitudinal movement toward and away from the plug assembly. Each movable receptacle contact 434*b* has a first protuberance 440 adjacent one end thereof for engagement with one of the plug contacts, and a second proturberance 442 adjacent the other end for sliding engagement with one of the fixed receptacle contacts 434*a*.

As shown in all of FIGS. 13–16, a knob 483 is provided for manually moving each movable receptacle contact 434*b* along the recessed guideway 482 in order to vary the position of the first protuberance 440 thereon toward and away from the plug assembly. Each knob 484 has a pair of legs 486 formed in one piece therewith. These legs are firmly engaged with lugs 488 on each movable receptacle contact 434*b*, so that each knob is movable with one of the movable receptacle contacts. Also formed in one piece with each knob 484 is a finger grip 490 which is engaged in one of guide slots 492 in the pair of opposed side walls 446 of the receptacle housing 432. Each guide slot 492 extends along one of the guideways 482.

Figure 16:
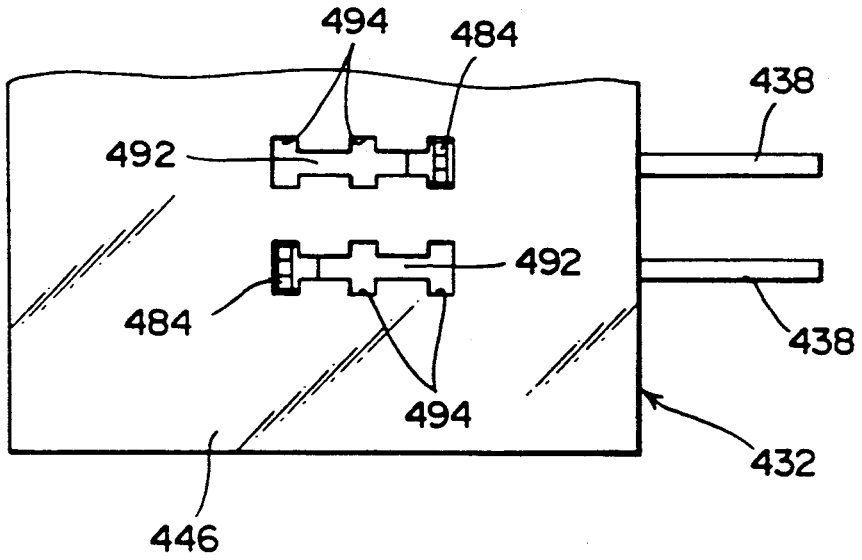
FIG. 16 is an enlarged, fragmentary side elevation of the FIG. 13 receptacle assembly.

As best revealed by FIG. 16, each guide slot 492 has two or more, three in this embodiment, lateral expansions 494 in longitudinally spaced positions thereon. The finger grip 490 on each knob 484 when somewhat pushed into the receptacle housing 432 is movable along the associated guide slot 492 and, when released, is engageable in any desired one of the three lateral expansions 494 of the guide slot. Each knob 484, and therefore the movable receptacle contact 434*b* engaged therewith, is locked against longitudinal displacement when its finger grip 490 is engaged in one of the lateral expansions 494 of the guide slot 492.

Operation of Fifth Embodiment

The knobs 484 on the opposite side walls 446 of the receptacle housing 432 may be selectively moved back and forth along the guide slots 492 and locked in any of the three lateral expansions 494 of each guide slot. The movable receptacle contacts 434*b* will travel with the knobs 484 along the recessed guideways 482, with their second protuberances 442 held in sliding engagement with the respective fixed receptacle contacts 434*a*. The first protuberances 440 on the movable receptacle contacts 434*b* can thus be selectively moved to, and locked in, any of the three different positions in the longitudinal direction of the receptacle contacts.

Thus, in this receptacle assembly 414, the signal, power, and ground contacts are independently movable to the three different positions for engagement with, and disengaged from, the associated plug contacts at different moments in time. The receptacle assembly 414 also requires no alteration of its constituent parts for adapting itself to different system requirements. As an additional advantage, the movable receptacle contacts are not to be displaced upon engagement with, or during disengagement from, the plug contacts as the knobs 484 are locked in the lateral expansions 494 of the guide slots 492.

Although we have shown and described the separable multicontact connector of our invention in terms of several preferred forms thereof, we do not wish our invention to be limited by the exact details of such specific forms. A variety of modifications, alterations and adaptations will readily suggest themselves to those skilled in the art in order to conform to design preferences or to the requirements of each specific application of this invention, without departing from the scope of the following claims.

We claim:

1. A separable multicontact electric connector suitable for use with packaged electronic circuits or the like, comprising:

(A) a plug assembly:

(a) a plug housing of electrically insulating material; and (b) a plurality of plug contacts fixedly mounted to the plug housing; and (B) a receptacle assembly coupled, both mechanically and electrically, to the plug assembly to a separable manner, the receptacle assembly comprising:

(a) a receptacle housing of electrically insulating material capable of interfitting engagement with the plug housing;

(b) a plurality of generally elongate receptacle contacts of resilient material mounted to the receptacle housing for engagement with the respective plug contacts upon interfitting engagement of the receptacle housing with the plug housing;

(c) a first and a second protuberance formed in longitudinally spaced positions on each receptacle contact, each receptacle contact being so made that only the second protuberance of each receptacle contact is normally held against one associated plug contact upon interfitting engagement of the receptacle housing with the plug housing; and (d) abutment means on the receptacle housing for abutting engagement with any selected one of the receptacle contacts, any selected receptacle contact in engagement with the abutment means being thereby resiliently displaced in such a direction that not only the second protuberance but also the first protuberance thereon becomes held against one associated plug contact upon interfitting engagement of the receptacle housing with the plug housing.

2. The separable multicontact electric connector of claim 1 wherein the abutment means of the receptacle assembly comprises a projection formed on the receptacle housing.

3. The separable multicontact electric connector of claim 1 wherein the abutment means of the receptacle assembly comprises:

(a) at least one adapter removably mounted to the receptacle housing; and (b) at least one projection formed on the adapter for abutting engagement with any selected receptacle contact.

4. The separable multicontact electric connector of claim 1 wherein the receptacle housing is substantially in the form of a box, open toward the plug assembly, with the receptacle contacts arranged in two rows therein, and wherein the abutment means comprises:

(a) a pair of adapter plates removably mounted to a pair of opposed side walls of the receptacle housing in a confronting relation to each other; and (b) at least one projection formed on each adapter plate for abutting engagement with any selected receptacle contact.

5. The separable multicontact electric connector of claim 1 wherein each receptacle contact is in the form of a single strip of sheet metal formed to include two rounded parts to provide the first and the second protuberances.

6. The separable multicontact electric connector of claim 1 wherein each receptacle contact comprises two parallel strip portions of sheet metal integrally joined to each other and folded one over the other, the two strip portions being different in length and both having rounded end portions to provide the first and the second protuberances.

7. The separable multicontact electric connector of claim 1 wherein the abutment means of the receptacle assembly comprises a plurality of contact pushers movably mounted to the receptacle housing and each opposed to one of the receptacle contacts, the contact pushers being selectively actuable into abutting engagement with the associated receptacle contacts.

8. The separable multicontact electric connector of claim 7 wherein the receptacle housing is substantially in the form of a box, open toward the plug assembly, with the receptacle contacts arranged in two rows therein, and wherein the contact pushers of the abutment means of the receptacle assembly are pivotably mounted in windows formed in a pair of opposed side walls of the receptacle housing.

9. The separable multicontact electric connector of claim 8 wherein the abutment means of the receptacle assembly further comprises a pair of retainer plates mounted to the pair of opposed side walls of the receptacle housing for retaining the contact pushers in position.

10. A separable multicontact electric connector suitable for use with package electronic circuits or the like, comprising:

(A) a plug assembly comprising:

(a) a plug housing of electrically insulating material; and (b) a plurality of plug contacts fixedly mounted to the plug housing; and (B) a receptacle assembly coupled, both mechanically and electrically, to the plug assembly in a separable manner, the receptacle assembly comprising:

(a) a receptacle housing of electrically insulating material capable of interfitting engagement with plug housing;

(b) a plurality of fixed receptacle contacts fixedly mounted to the receptacle housing;

(c) a plurality of generally elongate, movable receptacle contacts mounted to the receptacle housing for movement toward and away from the plug assembly, including a plurality of knobs coupled respectively to each movable receptacle contact and movable along guide slots formed in the receptacle housing, each of the guide slots including a plurality of lateral expansions in which an associated one of the knobs is capable of engagement against accidental movement along the guide slot;

(d) a first protuberance formed on each moveable receptacle contact adjacent to one end thereof for engagement with one of the plug contacts upon interfitting engagement of the receptacle housing with the plug housing;

(e) a second protuberance formed on each movable receptacle contact adjacent to the other end thereof for sliding engagement with one of the fixed receptacle contacts; and (f) means for independently moving the movable receptacle contacts relative to the receptacle housing toward and away from the plug assembly.

11. The separable multicontact electric connector of claim 10 wherein the receptacle housing is in the form of a box, open toward the plug assembly, with the fixed receptacle contacts arranged in two rows within the receptacle housing, and with the movable receptacle contacts slidably mounted to a pair of side walls of the receptacle housing, and wherein the means for moving the movable receptacle contacts comprises a plurality of knobs coupled one to each movable receptacle contact and movable along guide slots formed in the side walls of the receptacle housing.

* * * * *

UNITED STATES PATENT AND TRADEMARK OFFICE

CERTIFICATE OF CORRECTION

PATENT NO. : 5,080,613

DATED : JANUARY 14, 1992

INVENTOR(S) : KAZUYA ORUI ET AL.

It is certified that error appears in the above-identified patent and that said Letters Patent is hereby corrected as shown below:

Col. 9, line 62, "483" should be --484--.

Col. 12, line 18, "package" should be --packaged--.

Signed and Sealed this

Thirteenth Day of April, 1993

*Attest:*

STEPHEN G. KUNIN

*Attesting Officer*

*Acting Commissioner of Patents and Trademarks*